US010507647B1

(12) United States Patent
Tal

(10) Patent No.: US 10,507,647 B1
(45) Date of Patent: Dec. 17, 2019

(54) METHODS AND SYSTEMS FOR COMPENSATING FOR A MALFUNCTIONING NOZZLE IN A DIGITAL PRINTING SYSTEM

(71) Applicant: LANDA CORPORATION LTD., Rehovot (IL)

(72) Inventor: David Tal, Rehovot (IL)

(73) Assignee: LANDA CORPORATION LTD., Rehovot (IL)

( * ) Notice: Subject to any disclaimer, the term of this patent is extended or adjusted under 35 U.S.C. 154(b) by 0 days.

(21) Appl. No.: 16/237,608

(22) Filed: Dec. 31, 2018

Related U.S. Application Data

(60) Provisional application No. 62/612,881, filed on Jan. 2, 2018.

(51) Int. Cl.
*B41J 2/045* (2006.01)

(52) U.S. Cl.
CPC ..... *B41J 2/0451* (2013.01); *B41J 2/04586* (2013.01)

(58) Field of Classification Search
CPC .. B41J 2/0451; B41J 2/04561; B41J 2/04558; B41J 2/04586
See application file for complete search history.

(56) References Cited

U.S. PATENT DOCUMENTS 6,575,549 B1 6/2003 Silverbrook et al.
7,289,248 B2 * 10/2007 Yamazaki ..... B41J 2/04508 347/15
8,411,326 B2 4/2013 Inoue et al.
8,496,313 B2 7/2013 Ueshima et al.
8,646,862 B2 2/2014 Wu et al.
8,646,869 B2 2/2014 Yamazaki et al.
8,740,339 B2 6/2014 Yamazaki et al.
9,218,645 B2 12/2015 Shibata et al.
2004/0189556 A1 9/2004 Tsujino et al.
2004/0223014 A1 11/2004 Barr et al.
2005/0083361 A1 4/2005 Nakanishi et al.
2015/0360491 A1 12/2015 Billow et al.
2019/0134990 A1 5/2019 Siman-Tov et al.

FOREIGN PATENT DOCUMENTS

WO WO-2015029789 A1 3/2015

OTHER PUBLICATIONS

WO2015029789 Machine Translation (by EPO and Google)—published Mar. 5, 2015, Fujifilm Corp.

* cited by examiner

*Primary Examiner* — Thinh H Nguyen
(74) *Attorney, Agent, or Firm* — Marc Van Dyke

(57) ABSTRACT

Printing an image, using a printing system having a malfunctioning or inoperative nozzle corresponding to a column of affected positions in a half-toned digital image, includes modifying the half-toned digital image, using a pre-print digital processor of the printing system to compute a modified version of the half-toned digital image, such that droplet sizes are increased only in the two neighboring columns and according to a value of a compensation function, and printing the modified half-toned digital image on the target surface. Values of the threshold-based compensation function are based on a luminance-debt function defined by an iterative row-by-consecutive-row computation procedure, where for each iteration step the luminance-debt function is re-calculated according to data representing the ink values of affected positions and data representing the instant value of the compensation function.

9 Claims, 14 Drawing Sheets

| | $C_1$ | $C_2$ | $C_3$ | $C_4$ | $C_5$ | $C_6$ | $C_7$ | $C_8$ | $C_9$ | $C_{10}$ |
|---|---|---|---|---|---|---|---|---|---|---|
| $R_1$ | 0 | 1 | 1 | 0 | 0 | 0 | 1 | 1 | 1 | 1 |
| $R_2$ | 1 | 1 | 1 | 0 | 1 | 0 | 1 | 0 | 1 | 1 |
| $R_3$ | 0 | 0 | 1 | 0 | 0 | 1 | 1 | 1 | 1 | 0 |
| $R_4$ | 0 | 1 | 0 | 1 | 1 | 1 | 0 | 0 | 1 | 1 |
| $R_5$ | 1 | 1 | 1 | 1 | 1 | 0 | 1 | 1 | 0 | 1 |
| $R_6$ | 1 | 1 | 0 | 1 | 0 | 1 | 0 | 1 | 1 | 1 |
| $R_7$ | 0 | 1 | 1 | 0 | 1 | 1 | 1 | 1 | 0 | 0 |
| $R_8$ | 1 | 0 | 1 | 1 | 0 | 0 | 1 | 1 | 1 | 1 |
| $R_9$ | 1 | 1 | 1 | 1 | 1 | 1 | 0 | 1 | 1 | 1 |
| $R_{10}$ | 0 | 1 | 1 | 1 | 1 | 0 | 1 | 1 | 1 | 1 |

| | $C_1$ | $C_2$ | $C_3$ | $C_4$ | $C_5$ | $C_6$ | $C_7$ | $C_8$ | $C_9$ | $C_{10}$ |
|---|---|---|---|---|---|---|---|---|---|---|
| $R_1$ | 0 | 2 | 1 | 0 | 0 | 0 | 1 | 1 | 1 | 1 |
| $R_2$ | 1 | 1 | 2 | 0 | 1 | 0 | 1 | 0 | 1 | 1 |
| $R_3$ | 0 | 0 | 1 | 0 | 0 | 1 | 1 | 2 | 1 | 0 |
| $R_4$ | 0 | 1 | 0 | 2 | 1 | 2 | 0 | 0 | 1 | 1 |
| $R_5$ | 1 | 1 | 1 | 1 | 2 | 0 | 1 | 1 | 0 | 1 |
| $R_6$ | 1 | 1 | 0 | 1 | 0 | 1 | 0 | 1 | 2 | 1 |
| $R_7$ | 0 | 1 | 1 | 0 | 2 | 1 | 1 | 1 | 0 | 0 |
| $R_8$ | 1 | 0 | 1 | 1 | 0 | 0 | 1 | 2 | 1 | 1 |
| $R_9$ | 2 | 1 | 1 | 2 | 1 | 2 | 0 | 1 | 1 | 2 |
| $R_{10}$ | 0 | 1 | 1 | 1 | 1 | 0 | 1 | 1 | 1 | 1 |

| | *i-1* | *i* | i+1 |
|---|---|---|---|
| *j*=1 | 1 | 1 | 2 |
| *j*=2 | 2 | 2 | 2 |
| *j*=3 | 0 | 0 | 2 |
| *j*=4 | 1 | 2 | 1 |

FIG. 7

CONVENTIONAL SIMPLIFIED COMPENSATION FUNCTION

BEFORE COMPENSATION

AFTER COMPENSATION

BEFORE COMPENSATION

AFTER COMPENSATION

EXAMPLE OF A 4X3 ARRAY OF POSITIONS

| | *i-1* | *i* | i+1 |
|---|---|---|---|
| *j*=1 | 1 | 1 | 2 |
| *j*=2 | 2 | 2 | 2 |
| *j*=3 | 0 | 0 | 2 |
| *j*=4 | 1 | 2 | 1 |

*IMG*

*DS(j,i)*

FIG. 9

| | *i-1* | *i* | i+1 |
|---|---|---|---|
| *j*=1 | 1 | ~~1~~ | 2 |
| *j*=2 | 2 | ~~2~~ | 2 |
| *j*=3 | 0 | ~~0~~ | 2 |
| *j*=4 | 1 | ~~2~~ | 1 |

*IMG*

FIG. 10

EXAMPLE OF LDF THRESHOLD TABLE

| *LDF threshold* | *CF* |
|---|---|
| >1 (but ≤2) | 1 |
| >2 (but ≤2.5) | 2 |
| >2.5 | 3 |

FIG. 11

END OF 1ST ITERATION: LDF=1

| | *i-1* | *i* | *i+1* |
|---|---|---|---|
| *j*=1 | 1 | ~~1~~ | 2 |
| *j*=2 | 2 | ~~2~~ | 2 |
| *j*=3 | 0 | ~~0~~ | 2 |
| *j*=4 | 1 | ~~2~~ | 1 |

FIG. 12

END OF 2ND ITERATION: LDF=2

| | *i-1* | *i* | *i+1* |
|---|---|---|---|
| *j*=1 | 1 | ~~1~~ | 2 |
| *j*=2 | 3 | ~~2~~ | 3 |
| *j*=3 | 0 | ~~0~~ | 2 |
| *j*=4 | 1 | ~~2~~ | 1 |

FIG. 13

END OF 3RD ITERATION: LDF=1

| | *i-1* | *i* | *i+1* |
|---|---|---|---|
| *j*=1 | 1 | ~~1~~ | 2 |
| *j*=2 | 3 | ~~2~~ | 3 |
| *j*=3 | 0 | ~~0~~ | 2 |
| *j*=4 | 1 | ~~2~~ | 1 |

FIG. 14

END OF 4TH ITERATION: LDF=0

| | *i-1* | *i* | *i+1* |
|---|---|---|---|
| *j*=1 | 1 | ~~1~~ | 2 |
| *j*=2 | 3 | ~~2~~ | 3 |
| *j*=3 | 0 | ~~0~~ | 2 |
| *j*=4 | 2 | ~~2~~ | 3 |

FIG. 15

METHODS AND SYSTEMS FOR COMPENSATING FOR A MALFUNCTIONING NOZZLE IN A DIGITAL PRINTING SYSTEM

CROSS-REFERENCE TO RELATED APPLICATIONS

This patent application claims the benefit of U.S. Provisional Patent Application No. 62/612,881 filed on Jan. 2, 2018, which is incorporated herein by reference in its entirety.

FIELD OF THE INVENTION

The present invention relates to systems and methods for printing an image using a digital printing system in which it has been determined that an ink ejection nozzle is malfunctioning or inoperative modifying printing controlling various aspects of a digital printing system using an intermediate transfer member. In particular, the present invention is suitable for printing systems in which a liquid formulation is applied to the intermediate transfer member.

BACKGROUND

Various printing systems are known that use an inkjet printing process, this being a process in which an inkjet printing head comprising many ink nozzles is used to eject droplets of ink onto a target surface in order to form a printed image thereon. During the course of operation, ink nozzles can malfunction, become inoperable, become clogged, or have similar problems in which a nozzle is either unable to deposit ink droplets or, alternatively, deposits ink droplets in the wrong place or with the wrong quantity of ink. As a result, print quality can be reduced. Simple techniques for 'compensating' for the visual effects 'bad' nozzles are known in the art, such as digitally spreading the quantity of ink that was meant to be printed in a particular location to neighboring locations. Simple nozzle compensation techniques, however, are known to leave unwanted visual artifacts in the printed image.

SUMMARY OF THE EMBODIMENTS

Aspects of disclosed embodiments relate to digital printing, in particular to a system and method capable to provide compensation for a malfunctioning image dot source, such as an ink nozzle or a light-emitting diode employed in an electrostatic digital printing process.

In particular, embodiments of the invention relate to techniques whereby sufficient compensation is provided to counteract the deleterious visual effects of a malfunctioning nozzle (i.e. which might create a white streak within the printed ink image) in a manner that is faithful to/harmonious with the underlying AM or FM screening. In this manner, it is possible to minimize the negative impact a failed or malfunctioning nozzle has upon the printed ink image.

Certain embodiments relate to a method of printing an image using a printing system that has a malfunctioning or inoperative nozzle, the malfunctioning or inoperative nozzle corresponding to a column of affected positions in a half-toned digital image, the half-toned digital image specifying the size of each ink droplet to be deposited at a corresponding location on a target surface. The method can comprise modifying the half-toned digital image responsive to a determination that a nozzle is malfunctioning or inoperative, using a pre-print digital processor of the printing system to compute a modified version of the half-toned digital image, such that droplet sizes are increased, for example only in the two neighboring columns and according to the value of a compensation function, and/or printing the modified half-toned digital image on the target surface, wherein values of the compensation function are defined by an iterative row-by-consecutive-row computation procedure applied to the entirety of the column of affected positions from one end to the other, where, for each iteration step, the value of a cumulative luminance-debt function can be incremented with data representing the droplet size of an affected position in the respective row of the iteration step, a positive value is assigned to a compensation function if the luminance-debt function exceeds a pre-determined threshold, an increase in droplet size is assigned in at least one position in first and second neighboring columns based on the value of the compensation function, the at least one position being in the same row and adjacent to the affected position, and/or the value of the luminance-debt function can be decremented with data representing the value of the compensation function.

In some embodiments, modifying the half-toned digital image can include setting droplet sizes for all rows of the column of affected positions to zero. In some embodiments, the iterative computation procedure applied to the half-toned digital image can include, for each iteration step, increasing the value of the luminance-debt function by a predetermined amount if a value of a counting function is in a predetermined range, wherein values of the counting function are defined by the iterative computation procedure, where for each iteration step, the value of the counting function is increased if the droplet size in the respective row is non-zero, and/or reduced if the droplet size is zero. The method can additionally comprise the step of storing the modified half-toned digital image in a non-transitory computer-readable storage medium.

Certain embodiments relate to a method of compensating for or reducing the visual effect of a malfunctioning or inoperative nozzle of a printing system, the malfunctioning or inoperative nozzle corresponding to a column of affected positions of a half-toned digital image that specifies the size of each ink droplet to be deposited at a corresponding location on a target surface. The method comprises modifying the half-toned digital image, responsive to a determination that a nozzle is malfunctioning or inoperative, using a pre-print digital processor of the printing system to compute a modified version of the half-toned digital image, such that droplet sizes are increased, for example only in the two neighboring columns and/or for example only if the value of a cumulative luminance-debt function exceeds at least a first pre-determined threshold, and/or printing the modified half-toned digital image on the target surface, wherein values of the luminance-debt function can be defined by an iterative row-by-consecutive-row computation procedure applied to the entirety of the column of affected positions from one end to the other, where for each iteration step the value of a cumulative luminance-debt function is incremented with data representing the droplet size of an affected position in the respective row of the iteration step, a positive value is assigned to a compensation function if the luminance-debt function exceeds a pre-determined threshold, and/or the value of the luminance-debt function is decremented with data representing the value of the compensation function.

In some embodiments, modifying the half-toned digital image can include setting droplet sizes for all rows of the column of affected positions to zero. In some embodiments, the iterative computation procedure applied to the half-toned digital image includes, for each iteration step, increasing the value of the luminance-debt function by a predetermined amount if a value of a counting function is in a pre-determined range, wherein values of the counting function are defined by the iterative computation procedure, where for each iteration step, the value of the counting function is increased if the droplet size in the respective row is non-zero, and/or reduced if the droplet size is zero. In some embodiments, the method can additionally comprise the step of storing the modified half-toned digital image in a non-transitory computer-readable storage medium.

Certain embodiments relate to a method of printing an image using a printing system that has a malfunctioning or inoperative nozzle, the malfunctioning or inoperative nozzle corresponding to a column of affected positions in a half-toned digital image, the half-toned digital image specifying the size of each ink droplet to be deposited at a corresponding location on a target surface. The method comprises modifying the half-toned digital image responsive to a determination that a nozzle is malfunctioning or inoperative, using a pre-print digital processor of the printing system to compute a modified version of the half-toned digital image, wherein the computing comprises iterating row-by-consecutive-row over an entirety of the column from one end to the other, each successive iteration step corresponding to a different row of the column, wherein values of a luminance-debt function are calculated during each iteration step by incrementing the value of the luminance-debt function with data representing the droplet size of an affected position in the respective row of the iteration step, setting the value of a compensation function if the luminance-debt function exceeds at least one pre-determined threshold, assigning an increase in droplet size of at least one position in first and second neighboring columns based on the value of the compensation function, the at least one position being in the same row and adjacent to the affected position, and/or decrementing the value of the luminance-debt function with data representing the value of the compensation function. The method additionally can comprise printing the modified half-toned digital image on the target surface, and/or storing the modified half-toned digital image in a non-transitory computer-readable storage medium.

Certain embodiments relate to a method of printing an image using a printing system that has a malfunctioning or inoperative nozzle, the malfunctioning or inoperative nozzle corresponding to a column of affected positions in a half-toned digital image, the half-toned digital image specifying the size of each ink droplet to be deposited at a corresponding location on a target surface. The method comprises modifying the half-toned digital image, responsive to a determination that a nozzle is malfunctioning or inoperative, using a pre-print digital processor of the printing system to compute a modified version of the half-toned digital image, wherein the computing comprises iterating row-by-consecutive-row over an entirety of the column from one end to the other, each successive iteration step corresponding to a different row of the column, and/or wherein during each successive step, values of a cumulative luminance-debt function are incremented with row-specific data, the value of a compensation function is set if the luminance-debt function exceeds at least one pre-determined threshold, and/or based on the value of the compensation function, an increase in droplet size is assigned for at least one position in first and second neighboring columns. The method also comprises printing the modified half-toned digital image on the target surface.

Certain embodiments related to a printing system for printing a half-toned digital image that specifies, for each position of the digital image whether or not an ink droplet is to be deposited at a corresponding location on a target surface along with a respective droplet size, the printing system comprising an array of nozzles for depositing droplets of ink onto the target surface so as to print, each nozzle of the array corresponding to a column of the half-toned digital image, and/or a pre-print processor for controlling deposition of the droplets by the nozzle array according to the content of the half-toned digital image, to print the half-toned digital image or a derivative thereof on the target surface, the pre-print processor comprising a non-transitory computer-readable storage medium containing program instructions for compensating for or reducing the visual effect of a malfunctioning or inoperative nozzle, wherein execution of the program instructions by the pre-print processor causes the pre-print processor to carry out the step of computing a modified version of the half-toned digital image, responsively to a determination that a nozzle is malfunctioning or inoperative, the computing comprising calculation of droplet-size increases in the first and second neighboring columns of a column of affected positions, by iterating row-by-consecutive-row over an entirety of the column from one end to the other, each successive iteration step corresponding to a different row, and/or by carrying out, for each iteration step, the following steps: incrementing the value of a luminance-debt function with data representing the droplet size of an affected position in the respective row of the iteration step, determining the value of a compensation function based on the value of the luminance-debt function, assigning an increase in droplet size in at least one position in first and second neighboring columns—the at least one position being in the same row and adjacent to the affected position and the position being mapped to a functional ink nozzle—and/or decrementing the value of the luminance-debt function with data representing the value of the compensation function.

In some embodiments, computing a modified version of the half-toned digital image can include setting droplet sizes for all rows of the column of affected positions to zero. In some embodiments, the non-transitory computer-readable storage medium can contain additional program instructions, the execution of the additional program instructions causing the pre-print processor, when computing a modified version of the half-toned digital image, to carry out, for each iteration step of the calculating droplet-size increases, the following additional steps: increasing a value of a counting function if the droplet size is non-zero, reducing the value of the counting function if the droplet size is zero, and/or increasing the value of the luminance-debt function by a predetermined amount if the value of the counting function is in a pre-determined range. In some embodiments, the non-transitory computer-readable storage medium can contain additional program instructions, the execution of the additional program instructions causing the pre-print processor to additionally carry out the step of storing the modified half-toned digital image in a non-transitory computer-readable storage medium.

Certain embodiments relate to a printing system for printing a half-toned digital image that specifies the size of each ink droplet to be deposited at a corresponding location on a target surface, the printing system comprising an array of nozzles for depositing droplets of ink onto the target surface so as to print, each nozzle of the array corresponding to a column of the half-toned digital image, and/or a pre-print processor for controlling deposition of the ink droplets by the nozzle array according to the content of the half-toned digital image, to print the half-toned digital image or a derivative thereof on the target surface, the pre-print processor comprising a non-transitory computer-readable storage medium containing program instructions for compensating for or reducing the visual effect of a malfunctioning or inoperative nozzle corresponding to a column of affected positions in the half-toned digital image, wherein execution of the program instructions by the pre-print processor causes the pre-print processor to carry out the step of computing a modified version of the half-toned digital image responsively to a determination that the nozzle is malfunctioning or inoperative, the computing comprising iterating row-by-consecutive-row over an entirety of the column from one end to the other, each successive iteration step corresponding to a different row of the column, wherein values of a luminance-debt function are calculated during each iteration step by incrementing the value of the luminance-debt function with data representing the droplet size of an affected position in the respective row of the iteration step, setting the value of a compensation function if the luminance-debt function exceeds at least one pre-determined threshold, assigning an increase in droplet size of at least one position in first and second neighboring columns based on the value of the compensation function, the at least one position being in the same row and adjacent to the affected position, and/or decrementing the value of the luminance-debt function with data representing the value of the compensation function.

Certain embodiments relate to a printing system for printing a half-toned digital image that specifies the size of each ink droplet to be deposited at a corresponding location on a target surface, the printing system comprising an array of nozzles for depositing droplets of ink onto the target surface so as to print, each nozzle of the array corresponding to a column of the half-toned digital image, and/or a pre-print processor for controlling deposition of the ink droplets by the nozzle array according to the content of the half-toned digital image, to print the half-toned digital image or a derivative thereof on the target surface, the pre-print processor comprising a non-transitory computer-readable storage medium containing program instructions for compensating for or reducing the visual effect of a malfunctioning or inoperative nozzle corresponding to a column of affected positions in the half-toned digital image, wherein execution of the program instructions by the pre-print processor causes the pre-print processor to carry out the step of computing a modified version of the half-toned digital image responsively to a determination that the nozzle is malfunctioning or inoperative, the computing comprising iterating row-by-consecutive-row over an entirety of the column from one end to the other, each successive iteration step corresponding to a different row of the column, and/or wherein during each successive step, values of a cumulative luminance-debt function are incremented with row-specific data, the value of a compensation function is set if the luminance-debt function exceeds at least one pre-determined threshold, and/or based on the value of the compensation function, an increase in droplet size is assigned for at least one position in first and second neighboring columns.

BRIEF DESCRIPTION OF THE DRAWINGS

The invention will now be described further, by way of example, with reference to the accompanying drawings, in which the dimensions of components and features shown in the figures are chosen for convenience and clarity of presentation and not necessarily to scale. In the drawings:

FIG. 7 is a tabular representation of a 4×3 matrix of positions (j,i) in a half-toned digital image.

FIG. 9 is another tabular representation of a 4×3 matrix of positions (j,i) in a half-toned digital image.

FIG. 10 shows the tabular representation of FIG. 9, with the positions (j,i) of an affected $i^{th}$ column crossed out.

FIG. 11 is a tabular representation of a lookup table translating luminance debt function LDF value thresholds to compensation function values, according to embodiments.

FIGS. 12, 13, 14 and 15 are tabular representations of a 4×3 matrix of positions (j,i) in a half-toned digital image, each representing the results of a successive iteration step in a modification of the half-toned digital image computed on the basis of an advanced compensation function according to embodiments.

DETAILED DESCRIPTION OF THE ILLUSTRATED EMBODIMENTS

The invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. Throughout the drawings, like-referenced characters are generally used to designate like elements.

For convenience, in the context of the description herein, various terms are presented here. To the extent that definitions are provided, explicitly or implicitly, here or elsewhere in this application, such definitions are understood to be consistent with the usage of the defined terms by those of skill in the pertinent art(s). Furthermore, such definitions are to be construed in the broadest possible sense consistent with such usage.

Figure 1A:
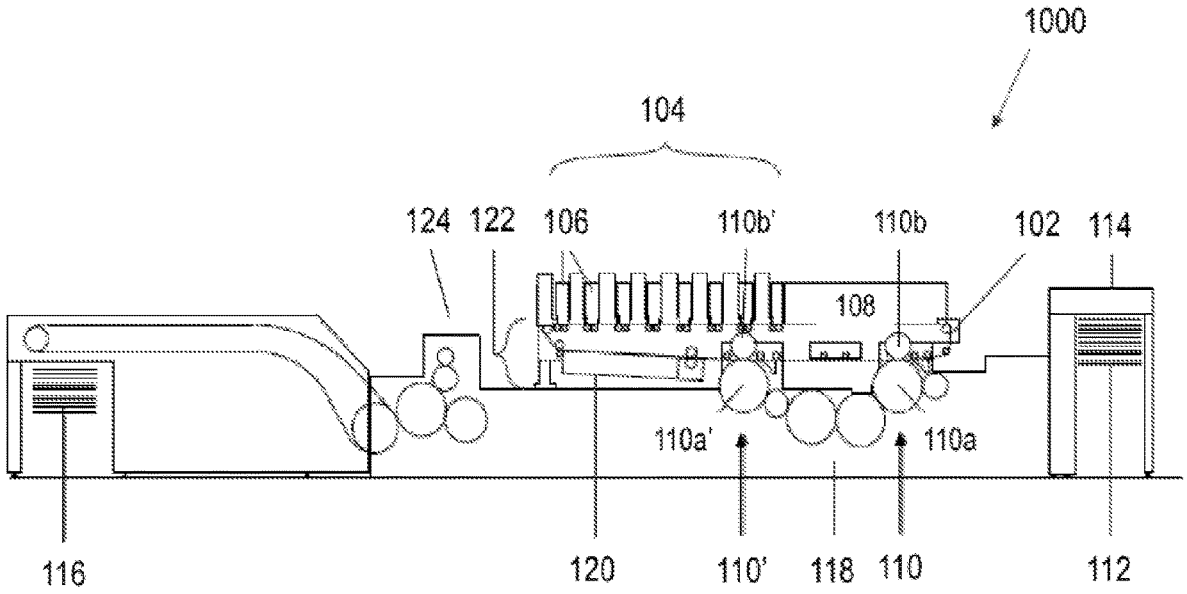
FIG. 1A is a schematic elevation view of a digital printing system, according to embodiments.

Reference is made to FIG. 1A. A printing system 1000 having an intermediate transfer member (ITM) 102 in the form of a blanket guided over various rollers of a blanket conveyor system 122 to travel in an endless loop as a belt, is schematically shown. While circulating through the loop, the blanket passes through various stations. The invention is equally applicable to printing systems wherein the intermediate transfer member is a drum, the specific designs of the various stations being accordingly adapted.

Figure 2A:
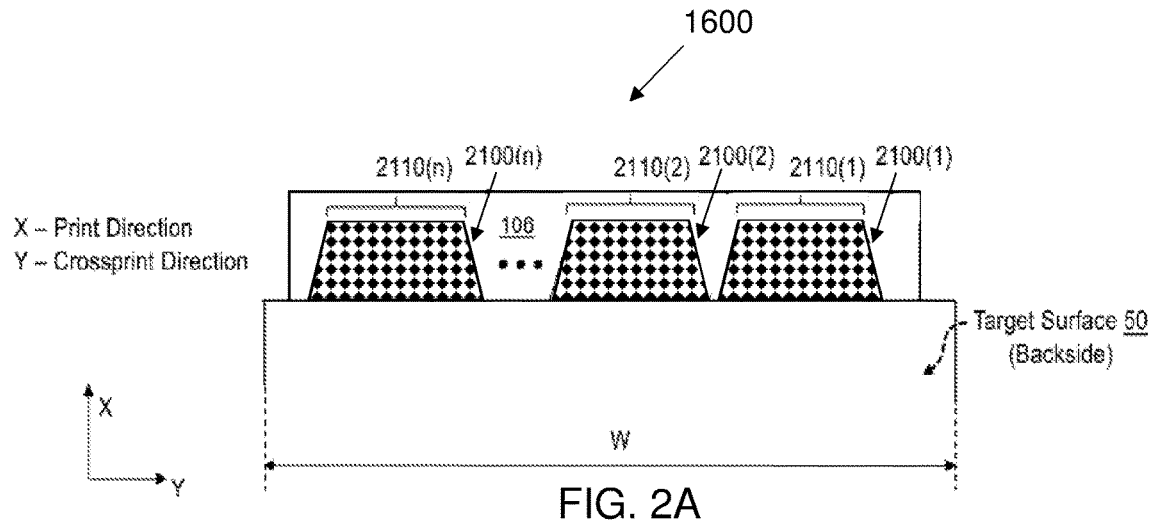
FIG. 2A is a schematic bottom view illustration of a plurality of printing heads on a printbar and of a backside of a target surface, each printing head comprising an array of ink ejection nozzles, according to an exemplary embodiment.

At an image forming station 104, print bars 106 deposit droplets of inks onto the image forming surface of the ITM 102 to form an ink image. The inks of the different bars 106, each comprising a plurality of printing heads better shown in FIGS. 2A and 3A, are usually of different colors and all the inks have particles of resin and colouring agent in a liquid carrier, apart from some transparent inks or varnishes which may not contain a pigment.

Though the image forming station illustrated in FIG. 1A comprises eight print bars 106, an image forming station may comprise fewer or more print bars. For instance, an image forming system may have three print bars each jetting cyan (C), magenta (M) or yellow (Y) inks, or four print bars with the addition of a black ink print bar (K).

The ITM 102 then passes through a drying station 108 where the ink droplets are at least partially dried and rendered tacky before they reach impression stations 110 where the ink droplets are transferred onto sheets 112 of substrate.

Two impression stations 110 are provided to enable printing on both sides of the substrate, one impression station being positioned upstream and the other downstream of the perfecting system. Each impression station 110, 110' includes an impression cylinder 110*a*, 110*a*' and a pressure roller 110*b*, 110*b*' which have between them a nip within which the blanket 102 is pressed against a substrate. In the illustrated embodiment, the substrate is formed as sheets 112 that are transferred from an input stack 114 to an output stack 116 by a substrate transport system 118. The substrate transport system 118, may comprise a perfecting system to allow double-sided, or duplex, printing.

In yet other embodiments, a single impression station 110 is provided, or more than two impression embodiments are provided. The illustrated system relates to a perfecting system capable of duplex printing—other embodiments relate to a simplex system which prints only on a single side of substrate.

It should be mentioned that the invention is equally applicable to printing systems designed to print on a substrate in the form of a continuous web instead of individual sheets. In such cases, the substrate transfer system is accordingly adapted to convey the substrate from an input roller to a delivery roller.

After passing through the impression stations 110, 110*a*', the ITM 102 may pass through other stations, such as a cleaning station 120, before returning to the image forming station 104. Printing systems may comprise additional stations adapted to their respective printing process and may further comprise, for instance, a treatment station for treating the ITM, a cooling or a heating station to modify the temperature of the intermediate transfer member along its path, a finishing station 124 for further processing the printed substrate (e.g., coating, trimming, punching, embossing, creasing, etc.), and so on. All such stations may rely on conventional equipment, or at least similar principles, and their integration in printing systems will be clear to the person skilled in the art without the need for more detailed description in the present context.

A problem in such a printing system, with which the present disclosure is concerned, is the deleterious visual impact malfunctioning image dot sources (e.g., clogged or deviating ink nozzles) may have on print quality.

A printing system according to embodiments disclosed herein is operative to determine the position for providing a compensating dot and the size of a compensating dot while retaining, as much as possible, the pattern of dots that would have been applied onto the target surface if no dot source was malfunctioning.

Determining the position and optimal size for providing a compensating dot may be performed heuristically based on empirical data (e.g., an input tone value and/or a percentage of coverage percentage), as outlined herein below in more detail.

In different embodiments, the target surface may be a printing substrate (e.g., paper, cardboard, plastic, fabric, etc.), an intermediate transfer member (ITM), an image receiving member receiving a liquid ink-based image from the ITM, or a selectively chargeable print drum of a LED-based printing system.

Figure 1B:
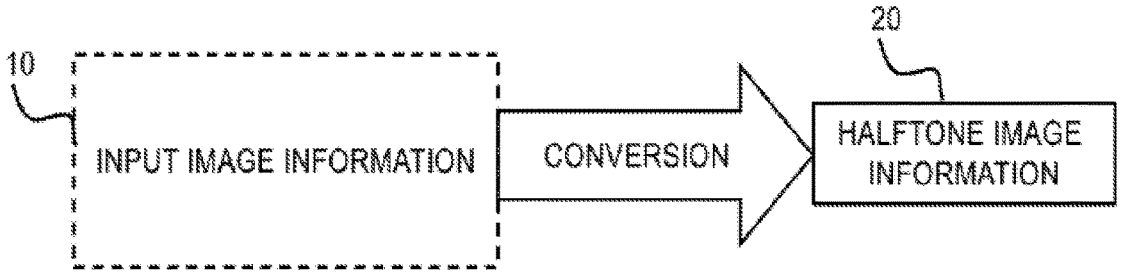
FIG. 1B is a a system flow chart schematically illustrating the operating principle of a digital printing system.

Reference is made to FIG. 1B. One salient feature of all digital printing systems is the conversion of data descriptive of continuous "input" image information into data descriptive of dots or static charges to be provided onto a target surface. As schematically shown in FIG. 1B, data descriptive of continuous input image information 10 may for example be stored in volatile and/or non-volatile computer memory and/or in other suitable storage (as outlined herein in greater detail) which is processed to print halftone image 20. More specifically, digital printing systems may be operative to convert data descriptive of input image information 10 into an output command signal for obtaining an ink ejection pattern or electric charges that yields a corresponding image on the target surface, using halftoning techniques, e.g., frequency modulation or amplitude modulation or a hybrid of the two. Halftoning techniques may include known and/or future halftoning methods.

Figure 2B:
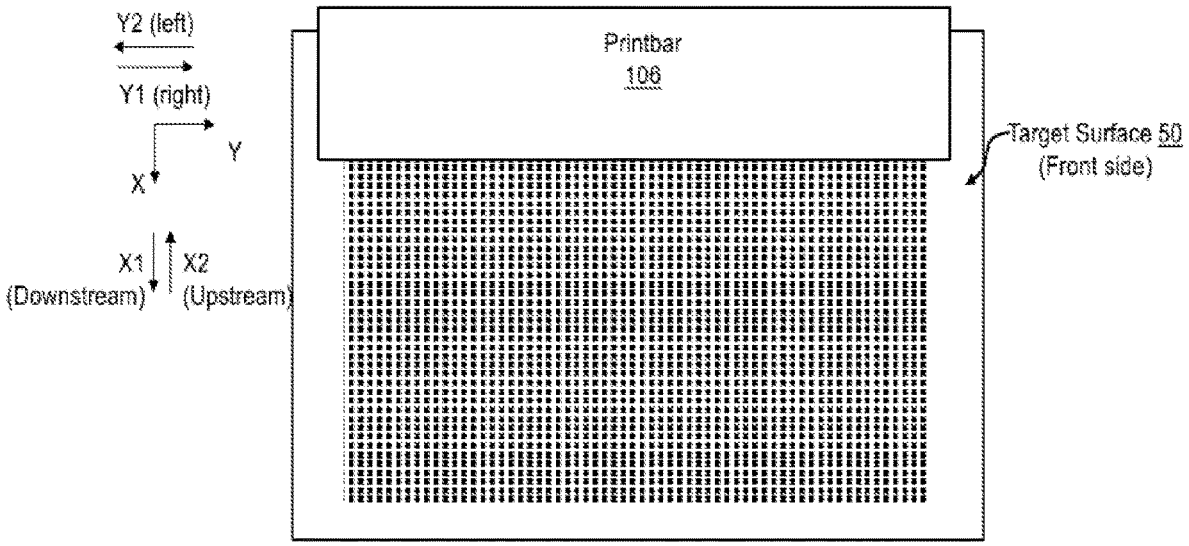
FIG. 2B is a schematic illustration of the front side of the target surface of FIG. 2A, and of an array of ink droplets arranged in an orthogonal grid applied onto the target surface, according to an exemplary embodiment

Further reference is now made to FIGS. 2A and 2B. The terms "print direction" or "printing direction" as used herein may refer to the direction of relative motion of halftoning dot sources and the target surface during printing. As shown in greater detail in FIG. 2B, the plane of the substrate 50 at the image forming station 104 defines a Cartesian plane comprising an x-axis and a y-axis, where a vector in the print direction (the direction of travel of the substrate 50 past a print head has only an x-axis dimension. An orthogonal vector in the plane of the substrate would therefore be called the 'cross-print' direction. The downstream direction along the x-axis (i.e., in the print direction) is represented by arrow X1 (also: "positive x-direction"), and the opposing, or upstream, direction is represented by arrow X2 (also: "negative x-direction").

The terms 'left' and 'right' used with respect to the position of pixel columns relative to a non-printed pixel column are defined by a viewing orientation onto a front side of a target surface 50 and in relation to the downstream or positive printing direction X1. Correspondingly, positive y direction (Y1) is referred to as pointing to the right, and negative y (Y2) direction is referred to as pointing to the left.

Figure 3:
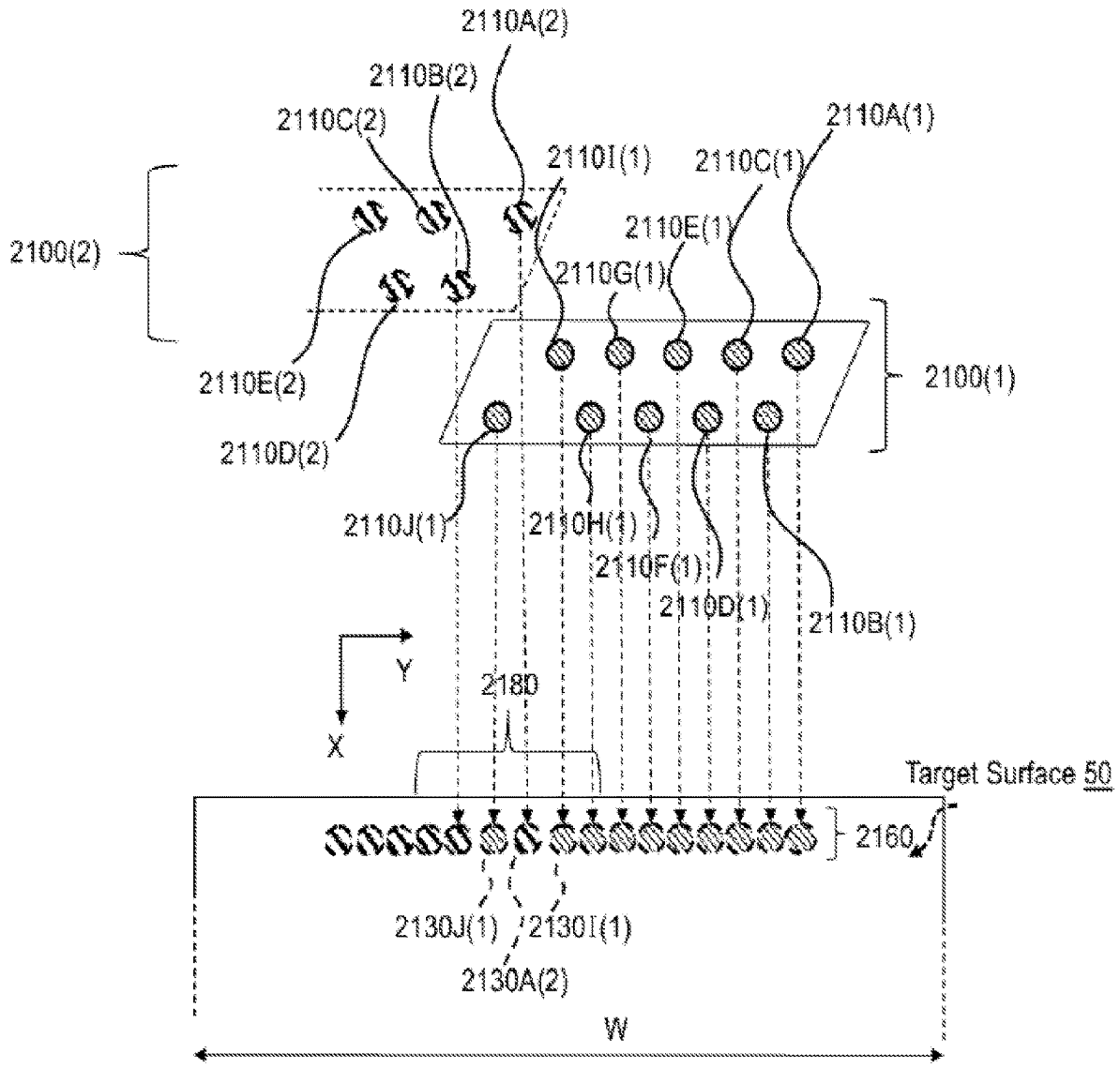
FIG. 3 is a schematic enlarged view of ink ejection nozzles and their corresponding printing projections onto a target surface, according to an exemplary embodiment.

Additional reference is made to FIG. 3. Printer apparatus 1600 schematically shown in FIG. 2A may comprise one or more printing heads, e.g., printing head 2100(1) and 2100 (2). Each printing head 2100(*n*) may include one or more dot sources, e.g., ink ejection nozzles 2110 (e.g., 2110A(n), 2110B(n), 2110C(n) and so on; n referring to a printing head number) arranged on printing heads 2100 in the present illustration. Merely to simplify the discussion that follows, only one printbar (see 106 in FIG. 1A) is schematically illustrated for the formation of a monochrome image based on, e.g., black ink. However, this should by no means to be construed as limiting. Accordingly, additional printbars may be employed, e.g., to enable the formation of a full-color image.

In embodiments, printbar 106 may be moveable relative to a target surface 50 along at least one of two print directions, for example in the cross-print direction y. A plurality of ink ejection nozzles 2110, schematically illustrated in FIG. 2A as dots, and as circles in FIG. 3, may be arranged along a direction y which may fully or at least partially extend over most of the width W of target surface 50. During printing, target surface 50 may be passed underneath the outlets of ink ejection nozzles 2110. The volume of an ink droplet ejected by any one of ink ejection nozzles 2110 may range, for example, from less than 2 picoliters to 60 or more picoliters. Clearly, alternative droplet volume ranges may be applicable.

As seen in the example illustrated in FIG. 3 with respect to 10 ink ejection nozzles 2110A to 2110J, ink ejection nozzles 2110 may be arranged such that a projection of ink ejection nozzles 2110 in one of the print directions X1 or X2 will show its corresponding ink dots 2130 side-by-side each other, to form a single dot lineup 2160 on a target surface 50 extending in cross-print direction (y-direction, which is perpendicular to print direction x).

A printing head 2100 may comprise along a print direction x at least two columns of ink ejection nozzles 2110. The at least two columns of ink ejection nozzles 2110 may be arranged offset in the x-direction relative to each other such as to attain a staggered arrangement for which a projection in the print direction results in a non-overlapping and, optionally, interlaced arrangement projection of dots 2130 that can be seen as a single dot lineup 2160. Such arrangement of ink ejection nozzles 2110 allows attaining an increased density of dots per inch (DPI), compared to the DPI that may be obtainable if printing head 2100 was employing ink ejection nozzles 2110 arranged in Y-direction in one column only. It is noted, however, that in some embodiments, a single column or, alternatively, more than two columns of ink ejection nozzles 2110 may be acceptable to obtain a single dot lineup 2160 of projected dots 2130.

Printing head 2100 may employ a multitude (e.g., employ hundreds or thousands) of ink ejection nozzles 2110 which are arranged so as to allow for the timed deposition or ejection of ink dots side-by-side in Y-direction according to a single nozzle line 2160 formed perpendicular to the relative print direction of target surface 50. In a non-limiting example, printing head 2100 may employ or comprise ink ejection nozzles that are arranged in at least 10 or at least 50 rows. Each row of nozzles may comprise 28 or 24 or 32 or 40 ink ejection nozzles.

An ink ejection nozzle in a plurality of nozzles in a printing head employed by a digital printing system is called herein an 'inoperative' or 'malfunctioning' nozzle when that nozzle is clogged, broken, physically removed or otherwise incapacitated, whether temporarily or permanently, inoperability or malfunction causing it to not eject ink drops (also called droplets) when instructed to do so by a printing system controller. In some cases, 'malfunctioning' can mean herein that a nozzle has become misaligned or damaged, causing it to deposit ink drops off-target, i.e., not in the exact location on a target surface where it is meant to be depositing ink drops. In some other cases herein a nozzle can be called 'malfunctioning' if it is seen to be ejecting droplets that are larger or smaller than intended or instructed. In a printing system in which there is relative linear movement between a printing head and a print target (a final, i.e, non-intermediate, print target is also called 'substrate') such as a sheet of paper in a sheet-fed press, or a continuous print medium such as paper or plastic in a web press, or an intermediate print target such as a belt or drum upon which images are formed for subsequent transfer to a substrate such as, for example, paper or plastic, that linear movement is considered to be in the 'print direction' as discussed with reference to FIGS. 2A and 2B. Typically, a printing head is stationary and the print target is conveyed in the print direction, but this is not necessarily so, and other arrangements of printing heads and print targets engendering relative movement are possible. The relative linear movement means that a single inoperative or malfunctioning nozzle will, during the course of printing an image, produce a one-dimensional array—a column—of 'blank' or 'white' physical locations on the print target, i.e., without ink, even if there was meant to be ink in some or all of those locations. Similarly, a malfunctioning nozzle can produce undesirable results, such as printing outside the confines of the intended column, or depositing too much or too little ink in the column.

The term 'location' as used herein means a real-world physical location on a target surface whereupon ink drops may be deposited during the course of printing an image.

Figure 4:
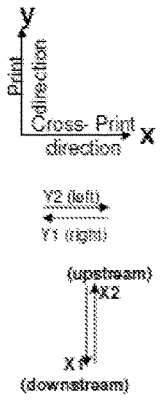
FIG. 4 is a table illustrating a first example of half-toned source data.

FIG. 4 illustrates one non-limiting example of a half-toned digital image typically stored in computer memory after half-toning a grayscale image and before printing. In this small example of a 10×10 matrix of positions, the half-toning was done in a 'single-bit' technique, meaning that the value of each position in the half-tone matrix is either '0' or '1', specifying whether an ink droplet is to be deposited at the location on the target surface corresponding to the respective position in the half-tone matrix.

Figure 5:
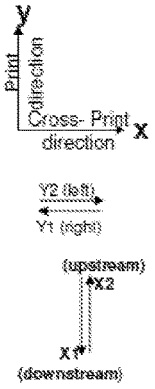
FIG. 5 is a table illustrating a second example of half-toned source data.

In contrast, the half-toned digital image of FIG. 5, which illustrates a multi-bit halftoning of the same grayscale image as in FIG. 4, specifies droplet size as well, as can be seen from the position droplet size values not being limited to '0' and '1'.

Figure 6:
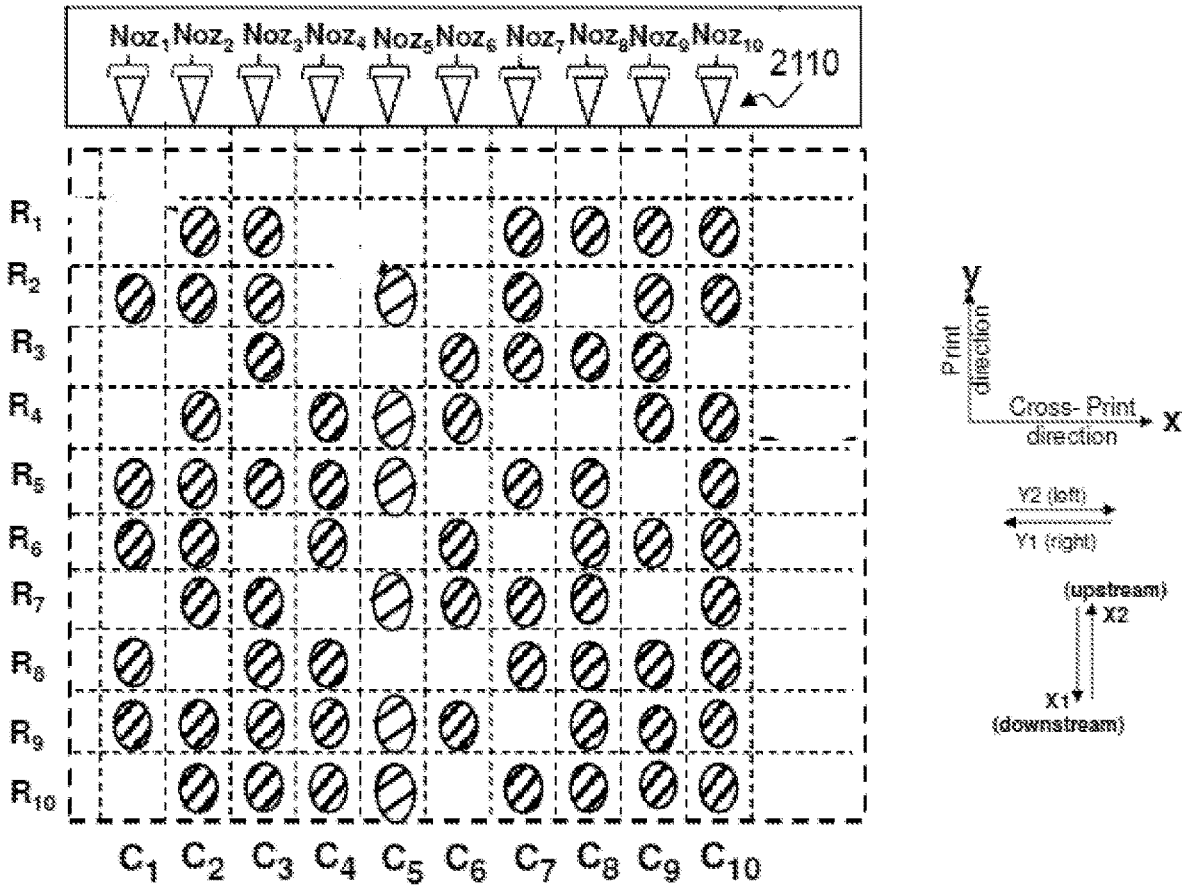
FIG. 6 is a drawing illustrating deposition of droplets onto a target surface by nozzles at locations, and optionally droplet sizes, specified by the half-toned source data, according to an exemplary embodiment.

FIG. 6 illustrates an array of 10 nozzles $Noz_1 \ldots Noz_{10}$ which collectively print the digital image IMG of FIG. 4 or FIG. 5 which comprises a matrix of positions (j,i). Each nozzle $Noz_i$ (in this example, $1 \leq i \leq 10$) is disposed in a physical location (i.e. in the cross print direction) corresponding to a respective $i^{th}$ column of the matrix of either FIG. 4 or FIG. 5. In embodiments, the array of nozzles $Noz_1 \ldots Noz_{10}$ and the target surface are in motion relative to each other in the print direction, and the droplet deposition timing of each nozzle is electronically controlled to produce the pattern specified by a respective column of IMG. In one example, the nozzles are stationary while the target surface is in motion in the print direction; in another example, the target surface is stationary while the nozzles are in motion in the print direction. As illustrated in FIG. 6, droplets (shown as striped ovals) are deposited only at locations on the target surface that correspond to a position (j,i) within IMG where a non-zero droplet size is present.

In embodiments, a single image can comprise millions of locations. In digital printing, images are printed from a half-toned digital image comprising a matrix of elements that can correspond on a one-to-one basis with locations on the target surface. A matrix can represent the entire image or a portion thereof. In examples herein, small matrices are illustrated for purposes of clarity, whereas entire images can comprise very large matrices with millions of elements. The term 'position' is used herein to mean such a matrix element in a half-toned digital image. A specific position in a half-toned digital image, or in a matrix representation of the image or a portion thereof, corresponds one-to-one to a specific location on a target surface with respect to each printing of the image. The 'droplet size' of a position is a numerical representation of the amount of ink that is to be deposited by the printing system at the location corresponding to the position. In embodiments, the droplet size can be a liquid volume, or a diameter of a drop before or after depositing on a print target surface. Alternatively, the droplet size can be a quantity of drops to be deposited at a single location corresponding to a position. A droplet size can be zero or can be a positive number in accordance with the design of a printing system, and can be a representative number for the actual ink volume or drop diameter and is translated by a processor of a printing system to a droplet diameter or an ink volume of a droplet. As an example, a '0' or zero drop size can mean no ink droplet is to be deposited, a '1' drop size can mean a droplet with a droplet diameter of 30 nm, and a '2' drop size can mean a droplet with a droplet diameter of 40 microns. In another example, '1' can mean a droplet with a volume of 20 picoliters and a '2' can mean a droplet with a volume of 35 picoliters.

As described earlier in more general terms, the relative linear movement of a print target relative to a printing head means that a single inoperative or malfunctioning nozzle will, during the course of printing an image, produce a one-dimensional array of physical locations on the print target that appear to have a droplet size of zero, even if some or all of the positions in the half-toned digital image corresponding to those locations had positive droplet sizes. Such positions are termed herein 'affected positions' if in a half-toned image or 'affected locations' if in a printed image. For example, a one-dimensional array of missing locations may comprise an M×1 column within a printed image comprising many such columns. The term 'column' represents a plurality of consecutive locations in the print direction (the x-direction), as opposed to 'row,' which represents a plurality of locations in the cross-print direction (the y-direction). A column of locations in a printed image corresponds to a column of positions in the half-toned digital image from which the image was printed, and a row of locations in a printed image corresponds to a row of positions in the half-toned digital image from which the image was printed. A one-dimensional array of affected locations typically occurs in the print direction when the phenomenon is due to a malfunctioning or inoperative nozzle. In a printed object, this can produce a blank or white line or streak that in some circumstances might require a print job to be discarded or a printing system shut down for major maintenance of a printing head, and therefore it is preferable to compensate for the inoperative or malfunctioning nozzle in a manner that will render the print job acceptable.

Compensating for a 'bad' (e.g., malfunctioning or inoperative) nozzle, and in particular compensating for the visual effect of a 'bad' nozzle, is primarily an attempt to create a pattern of ink on both sides (i.e., to the right and left sides as defined earlier) of the column of affected locations (an 'affected column') that can provide an impression, at least optically, that there are no missing or misdirected or improperly sized ink drops. The term 'nozzle compensation' is known in the industry as the practice of modifying the half-tone of an image before printing so as to conceal, or at least to disguise, the artifact that may result from printing with a 'bad' nozzle. The process of nozzle compensation as described herein, can include modification of portions of the halftoned digital image from which an image is printed, and further includes the printing of an image according to the modified half-tone and according to a set of rules for compensation. Halftoned digital images can be prepared by any of the halftoning (also known as 'screening') techniques known in the art, which include amplitude and/or frequency modulation halftoning, and a broad variety of publicly available dithering algorithms.

In embodiments, nozzle compensation comprises increasing droplet sizes in 'neighboring columns'. 'Increasing' can mean either adding a droplet where none was planned (i.e., increasing from zero to a positive number) or adding to the original, pre-compensation droplet size. 'Neighboring columns' are the two columns immediately to the left and right of an affected column. For example, a malfunctioning or inoperative nozzle can be nozzle $Noz_i$, corresponding to the $i^{th}$ column of a half-toned digital image IMG that specifies, for each position (j,i) of the digital image, the size of each ink droplet to be deposited at a corresponding location on a target surface. As can be seen in FIG. 7, which contains a small 4 row×3 column half-tone matrix, the $i^{th}$ column has first and second neighboring columns, respectively the $(i-1)^{th}$ and $(i+1)^{th}$ columns of the half-toned digital image IMG, disposed on opposite sides of the $i^{th}$ column. The rows in the figure are designated by the 'j' value of positions (j,i) of the matrix.

As is known in the art, nozzle compensation can be accomplished by a combination of adding ink drops where none were meant to be according to an original (pre-compensation) half-toned digital image, along with increasing the size, volume, quantity or diameter of ink drops that were already meant to be in a neighboring column. Different printing systems use different measures to increase the quantity of ink in a drop or expand the printed footprint of a drop, and some prior art printing systems are not designed to change drop size (volume or diameter) but rather they may be designed to eject multiple drops in the same location to have the same effect as changing drop size. Therefore, the terms of drop (or droplet) size, volume, quantity and diameter can be used interchangeably. The expansion of drop size can cause ink to appear to fall partly within the boundaries of the column of missing locations, whether as an optical trick or in reality, and thus can therefore be an important aspect of a compensation mechanism. By adding drops where they weren't meant to be in the pre-compensation halftone, and by increasing the size of planned drops in the adjacent positions in neighboring columns, the compensation mechanism may try to maintain an amount of ink that is close to the original total amount of ink in the area surrounding the affected locations, and may also cover part of the print area of the missing column on the print target surface in order to 'fool the eye' by breaking up the visually linear space of a column printed with zero drop sizes because of a bad nozzle.

It is known that different printed images have different patterns, including different densities of locations with positive droplet sizes and with different droplet sizes and patterns of droplet sizes in different portions of the images. In other words, every image can have a unique distribution of ink to locations. In embodiments, a compensation mechanism or compensation function can take into account the respective droplet sizes of the locations in the immediate surroundings of an affected location when attempting to compensate for the nozzle that caused the affected location (and the corresponding 'affected position' in the half-toned digital image from which the image is to be printed). In some images, there are areas with dense positive droplet sizes that make it difficult to find neighboring locations that can accept the increased ink of a compensation. For this reason, in some embodiments printers are adapted to allow extra-large ink drops that are not normally used in the everyday printing process, i.e., when all nozzles are functioning properly. This feature can be used to assign compensation beyond what normal drop size limitations would allow. For example, a printing press may accommodate drop sizes of 0, 1, and 2 on a regular basis, where 0 (zero) means 'no drop', but a half-toned digital image modified by a compensation function in order to compensate for a bad nozzle compensation may be permitted by the same printing press to increase the drop size of a location to 3. In another example, a printing press may accommodate drop sizes of zero, small and large on a regular basis, where zero means 'no drop', but a half-toned digital image modified by a compensation function in order to compensate for a bad nozzle compensation may be permitted by the same printing press to increase the drop size of a location to extra-large or even jumbo.

Throughout this disclosure, the following labeling convention will apply:

In a matrix with M rows and N columns of positions, which can be called an M×N matrix, each position is given a unique identifier (j,i), where:

j is the row number of the position (j,i)

i is the column number of the position (j,i)

For example, the position in the left-most column in the first row of a matrix is (1,1), the position to its right is (1,2) and the position below it is (2,1).

Each position (j,i) has a droplet size DS(j,i), which can have a range of possible values of, for example, 0, 1, 2 or 3. In some embodiments, a broader range of possible droplet sizes are possible. In some embodiments, droplet sizes are either integers or non-integers, and can represent a continuous range of values from zero to the maximum drop size with a precision defined by the specifications of the printing heads and nozzles.

Examples of a Conventional Simplified Compensation Function

Figure 8A:
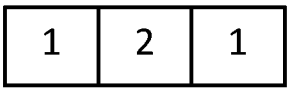
FIGS. 8A and 8B are tabular representations of 1×3 matrices of positions (j,i) in half-toned digital image, shown before and after application of a conventional simplified compensation function.
Figure 8A:
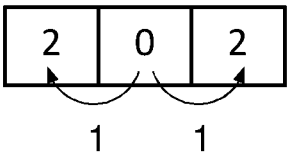

In a first example of a conventional simplified compensation function, a matrix such as illustrated in FIG. 8A comprises a single row of three positions (a 1×3 matrix) in a portion of a half-toned digital image $IMG_1$. According to the original (pre-compensation) halftoning of the digital image, each of the positions (j,i) was assigned droplet sizes DS(j,i) of either 1 or 2, and so the matrix appears in a pre-compensation half-tone of the image as [1 2 1]. In light of a malfunction of an ink ejection nozzle corresponding to the middle position, (1,2), the matrix, barring activation of a compensation mechanism, will most likely print as [1 0 1], where the location corresponding to the middle position (1,2) is likely to be empty, or in other words droplet size DS(1,2) will effectively be zero even if unintended. A simplified compensation function can attempt to modify the half-toned digital image by allocating what will be 'missing' ink (the ink that would not be printed because of the nozzle malfunction) evenly to the positions on the left and right of the missing position, i.e., in the adjacent positions in the neighboring columns. The after-compensation matrix, as shown, is thus [2 0 2]. It should be noted that this example is non-limiting because, for example, in alternative embodiments the quantity of ink in an ink droplet of size '2' need not be twice that of an ink drop of size '1', and the droplet size might merely be represented by a choice of number or letter or other character, each of which could be translatable by a pre-print processor to an actual droplet ink volume or drop diameter. In such an alternative embodiment, even a simplified a compensation function might assign other values to neighboring locations, and not simply divide a '2' into two '1's.

Figure 8B:
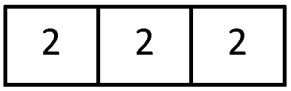
Figure 8B:
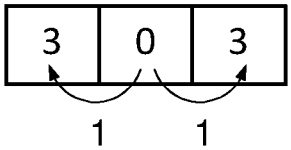

In a second example of a conventional simplified compensation function, a matrix such as illustrated in FIG. 8B comprises a single row of three positions (a 1×3 matrix) in a portion of a half-toned digital image $IMG_2$. According to the original halftone, each of the positions was assigned a droplet size of 2, and so the matrix appears in a pre-compensation half-tone of the image as [2 2 2]. In light of a nozzle malfunction corresponding to the middle position, (1,2), the matrix, barring activation of a compensation mechanism, will print as [2 0 2], where the middle position (1,2) is empty, or will appear to have a 'zero droplet size'. If the simplified compensation function of the first example were to be applied, then the 'missing' ink of the affected positions would be divided evenly between the two positions on the left and right of the affected position. However, in this second example each of the affected positions were already each intended to be printed with a maximal '2' droplet size. In the example, the limitation is overcome because the printing press used in this example is designed with a feature that allows a compensation procedure to increase the droplet size of each of the neighboring positions to '3', a value that is higher than the normal maximal value used processing halftoned digital images for this printing press. In this way the droplet size DS(1,2) of '2' can be divided evenly between positions (1,1) and (1,3) as shown in the figure, and the 1×3 matrix, post-modification by compensation function, now appears as [3 0 3].

In embodiments, an advanced compensation function uses a cumulative luminance-debt function that can be employed to retain and spread around much of the luminance that would be missing from an image comprising a matrix of positions if the image were to be printed without compensation in the case of a bad nozzle. The term 'luminance' in this disclosure means 'color value' or 'tonal value' and indicates a positive measure related to the quantity of ink specified in a half-toned image. The compensation function preferably iterates consecutively over all the rows of an affected column, starting with the first row and finishing with the last row, and can carry over residual luminance debt from row-to-row. 'Luminance debt' indicates a quantity of luminance that is 'owed' because it is considered to be missing from a printed image when a half-toned digital image with affected positions is printed by a printing system. Carrying over from row-to-row increases the blurring effect of a compensation function by homogenizing the missing luminance with the underlying pattern of ink droplets over a larger area than just a single affected position and its immediate neighbors, as was done in the example above of the conventional simplified compensation function.

Depending on the specific program instructions executed by a pre-print processor of a printing system, the compensation function can compute new droplet size values for each of the positions in the neighboring columns of an affected column, or alternatively it can compute column vectors of droplet size increases, respectively for each of the neighboring columns.

In embodiments, a pre-print digital processor of the printing system computes a modified version of a half-toned digital image by increasing droplet sizes in the two neighboring columns of an affected column—and only in the two neighboring columns. The droplet sizes of positions in the neighboring columns are increased if (and only) a value of a compensation function is positive.

In embodiments, the values of the compensation function are defined by an iterative computation procedure applied to the half-toned digital image. Each 'missing' drop, i.e., the volume of an ink droplet intended to be printed in the affected column, contributes to a cumulative luminance debt function. The contribution is based on the physical dot size. The luminance debt, i.e., the value of the debt function, can grow from iteration to iteration, depending on how much compensation is assigned in each iteration. If the luminance debt reaches a first threshold, then compensation can be assigned. If the luminance debt reaches one or more additional thresholds, then higher levels of compensation can be assigned. 'Assigning compensation' means allocating 'missing' luminance associated with positions in the affected column, to the immediate neighbors. Assigning compensation can include assigning a non-zero droplet size to a position where a 'zero' droplet size (i.e., no ink drop) had been assigned prior to compensation, in the original half-toned digital image. Assigning compensation can also include enlarging the planned ink drop, i.e., increasing the volume or size or quantity of the ink droplet that had been assigned prior to compensation, in the original half-toned digital image.

According to embodiments, values of the luminance-debt function and the compensation function are not carried over from one column to another in the case that there are multiple affected columns in a single half-toned digital image, and so the values of all functions are reset to zero before undertaking the iterative computation procedure for any affected column.

According to embodiments, the iterative computation procedure includes at least four computation steps in each iteration, each iteration corresponding to an affected position in a different row, but all in the same affected column.

In a first step, a luminance debt value is calculated and added to the running total of the cumulative luminance-debt function, which is carried over from iteration to iteration, but not from column to column in the case of images with multiple bad nozzles. The value can be calculated on the basis of ink volume, drop diameter, or number of drops. In some embodiments, the first step also includes employing a counter function that tracks ink density in a portion of a half-toned digital image. For example, the counter function can track consecutive positions in a column (specifically, in the affected column) that have non-zero droplet sizes in the half-tone. This can be useful for assessing the coverage density of luminance density of a portion of the image to be printed, and to make corrections to the compensation function in such a portion if the coverage density is in a selected range. In embodiments, the counter can be incremented if the affected position of the particular iteration has a non-zero droplet size, and the counter is reduced by subtraction of or division by a pre-determined constant if the affected position has a zero droplet size. In alternative embodiments, the counter can keep track of the number of consecutive appearances of a specific droplet size, for example the maximum standard droplet size generally used by the printing press, not counting larger droplet sizes that may be used when compensating for a bad nozzle.

In a second step, a value is assigned to a compensation function. According to embodiments, this is done on the basis of a threshold ladder: if the running total of the luminance-debt function exceeds a first threshold, then a first value is assigned to the compensation function. If the running total of the luminance-debt function exceeds a second threshold, then a second, higher, value is assigned to the compensation function. There can be two, three, four or more thresholds, each one indicating a different value that is to be assigned to the compensation function. It should be noted that if the luminance-debt function does not exceed the first (lowest) threshold, then no value is assigned to the compensation function, and no modification is made in this iteration to positions in the neighboring columns.

In a third step, which is performed only when the compensation function has been assigned a value greater than zero, position-specific compensation value is assigned to the respective same-row position in one or both of the neighboring columns. In embodiments, the compensation function value can be in terms of ink-quantity increases or droplet-size increases or droplet-count increases.

In order to 'offer compensation', i.e., to attempt to assign compensation value, to the respective positions in the neighboring columns, a check is made of the current values of the positions in the digital halftone of the image, and how much additional 'ink space' is available—i.e., how much additional ink can be assigned to the positions before the maximum droplet size or quantity for the printing system is reached. If all of the value of the compensation function 'fits' into this ink space, then all of the value of the compensation function for the present iteration is added in the respective positions in the neighboring columns. If not all of the value of the compensation function fits, then the entire value of the ink space can be assigned in those positions where less than the entire value of the ink space had previously been assigned, and the droplet sizes of the positions are thus brought up to the maximum for the printing system.

In a fourth step, the luminance-debt function is updated after the assignment of the compensation to respective position or positions in the neighboring columns. In some embodiments, the full value of the compensation function is subtracted from the cumulative luminance-debt function. In other embodiments only that part of the compensation function actually assigned as droplet size increases to the positions in the neighboring columns is subtracted from the luminance-debt function. The skilled artisan will understand the importance of adjusting the parameters of the compensation function in accordance with the actual performance of a specific printing system.

In some embodiments, the luminance-debt function can be additionally incremented by an adjustment value if the counter function calculated in the first step of the iteration step has reached a value within a predetermined range. In an example, a printing system designer may determine that the compensation function as disclosed herein tends to 'under-correct' in portions of a printed image in which luminance coverage, for example as a percentage of the total number of potential ink droplet locations, is repeatedly within a range of values. The under-correcting range of luminance coverage values may correlate with consecutive non-zero droplet size counter values, and so in an intersection of an affected column and such a portion of an image with luminance coverage in the specific range, it can be desirable to adjust the compensation function by 'artificially' incrementing (i.e., overstating) the luminance-debt function. In embodiments, the compensation adjustment can be on the basis of the counter function, for example if the number is within a pre-determined range.

Example of an Advanced Compensation Function

The following example of the iterative computation procedure of an advanced compensation function CF(j,i) will provide further illumination of some aspects of the present invention. In this example, the droplet size is used in the luminance-debt function without 'translation' to a different ink quantity-related variable.

In an example illustrated in FIG. 9, half-toned digital image IMG comprises a matrix of positions (j,i) with 4 rows and 3 columns. The value of droplet size DS(j,i) is shown for each position (j,i). As discussed earlier, the 'size' of a droplet can be a stand-in for a value of ink volume, droplet diameter or number of droplets to be deposited at each respective corresponding location on a target surface. A droplet size of zero in a position (j,i), as discussed earlier, means that according to the half-toning of image IMG, no ink droplet is to be deposited on the target surface at the corresponding location.

In the example, a determination has been made that nozzle $Noz_i$ (NOT SHOWN) corresponding to the $i^{th}$ column of the image IMG is malfunctioning or inoperative. Responsive to the determination that the nozzle $Noz_i$ is malfunctioning or inoperative, the half-toned digital image IMG in this example is to be modified using a pre-print digital processor of the printing system to compute a modified version of the half-toned digital image, IMG_MOD. As indicated in FIG. 10 by the values for all of the positions (j,i) in the $i^{th}$ column being crossed out, the $i^{th}$ column is the affected column and the luminance of the ink droplets intended for the affected column will be missing, due to the 'bad' nozzle $Noz_i$.

Specifically, the $(i-1)^{th}$ and $(i+1)^{th}$ columns will be modified, in that droplet sizes DS(j,i−1) and DS(j,i+1) will be modified for at least some rows j. In this illustrative example of an advanced compensation function, droplet sizes can be modified by being increased, but never decreased. 'Increasing' droplet size can mean increasing a non-zero droplet size, or it can mean changing a zero droplet size to a positive non-zero droplet size. Droplet sizes can also be left unchanged.

In the embodiment illustrated in this example, droplet sizes in the $j^{th}$ row in either of the neighboring columns can be modified (increased) only when a compensation function CF(j,i) is positive.

In order to start the iterative computation procedure to create the modified half-toned image IMG_MOD wherein we define values of the compensation function CF(j,i), we first reset our luminance-debt function LDF to zero. The luminance-debt function LDF tabulates, row-by-consecutive-row, how much luminance is lost in the $i^{th}$ column because of the 'bad' nozzle.

In each iteration in which compensation function CF(j,i) is positive, we will 'offer compensation' available from the compensation function CF(j,i) to the same-row position, first in one neighboring column and then the other. The order in which we will 'offer compensation' can be random, can change in each iteration of the procedure, or can be affected by previous compensation assigned by the compensation function in previous iterations, i.e., in previous rows.

$1^{st}$ Iteration, j=1

As shown in FIG. 10, for row j=1 (which is the subject of the first iteration), the droplet size planned for the $i^{th}$ column, DS(1,i), was '1'. The 'missing' luminance of the droplet in this position is the basis for incrementing the value of luminance-debt function LDF. The value DS(j,i) can be used 'as is', or can be translated to a physical value, for example to a droplet diameter droplet volume, or droplet quantity (number of drops) based on a look-up table or based on program instructions included in the programming instructions executed by the pre-print processor.

We add the data for the missing ink droplet—for example, DS(1,i), to our luminance-debt function LDF. LDF was reset to zero before the first iteration, and so we now increase it to 1.

In some embodiments, LDF must reach or exceed a first threshold of luminance-debt before compensation is offered to the neighboring columns. In some embodiments there can be more than one threshold, with each respectively higher threshold triggering a higher level of compensation, i.e., value assigned to compensation function CF(j,i).

In our example, there are three LDF thresholds, as illustrated in FIG. 11, each with a different resultant value of CF(j,i). The threshold values in our example are >1 (but ≤2), >2 (but ≤2.5) and >2.5. In other examples, the thresholds are lower. In still other examples, the thresholds are higher. Thresholds can be adjusted based on printed results, in order to fine-tune the compensation function. In FIG. 11, the LDF threshold is expressed as a simple number (a scalar). In other embodiments, the LDF threshold can be expressed in terms of values of droplet diameters or ink volumes, or as multiples thereof.

Since our current LDF of 1 does not meet the requirement of the first threshold, i.e., 1 is not greater than 1, then a value of zero is assigned to compensation function CF(j,i) for j=1—no compensation is assigned to the neighboring columns, and no modifications to the half-toned digital image IMG are made in this iteration. No compensation is decremented from the luminance-debt function.

At the end of the first iteration, as shown in FIG. 12, the 4×3 matrix of IMG is unchanged relative to FIG. 10.

$2^{nd}$ Iteration: j=2

The droplet size in the j=2 row of the $i^{th}$ column, or DS(2,i), is 2. We can add this to the luminance-debt function LDF which equaled 1 at the end of the previous iteration, and now LDF is equal to 3. Referring to the thresholds shown in the table in FIG. 12, we see that since LDF is greater than 2.5, a value of '3' is assigned to compensation function CF(j,i) for j=2.

Since CF(2,i) is now greater than zero, we can 'offer compensation' to the positions in the $j^{th}$ row of the two neighboring columns. In the original array, the two positions each had a droplet size DS(j,i) of '2'. There is available space in both positions between '2' and the printing system maximum of '3' to add '1' in each position, and that is now carried out.

Since some of the luminance-debt function LDF has been 'converted' to compensation during this iteration, we subtract data representing the CF function value from the debt-luminance function LDF. In some embodiments the entire CF(j,i) can be subtracted. In other embodiments, as in our example, only the portion of the compensation function that was actually used as compensation is subtracted. The luminance-debt function LDF, incremented earlier in this iteration to 3, is now decremented by 2, and at the end of the iteration, LDF=3−2=1.

FIG. 13 shows the modifications thus far to the 4×3 matrix of IMG as of the end of the $2^{nd}$ iteration.

$3^{rd}$ Iteration: j=3

The droplet size in the j=3 row of the $i^{th}$ column of half-toned digital image IMG, or DS(3,i), is 0. Therefore, there is to be no increment to the luminance-debt function LDF in this iteration.

LDF, at the end of the previous iteration, equaled 1 and remains 1. Referring again to FIG. 11, it can be seen that there is to be no compensation in this iteration because LDF does not exceed any of the thresholds shown in FIG. 11, and therefore CF(3,i) is equal to zero.

FIG. 14 shows the modifications thus far to the 4×3 matrix of IMG as of the end of the $3^{rd}$ iteration.

$4^{th}$ Iteration: j=4

The droplet size in the j=4 row of the $i^{th}$ column of IMG, or DS(4,i), is 2. We add this to the luminance-debt function LDF which equaled 1 at the end of the previous iteration, and now LDF is equal to 3. Addressing once again the thresholds shown in the table in FIG. 11, we see that since LDF is greater than 2.5, a value of '3' is assigned to compensation function CF(j,i) for j=4.

Since CF(4,i) is now greater than zero, we can 'offer compensation' to the positions in the $j^{th}$ row of the two neighboring columns. Each of the positions has an original droplet size DS(j,i) of '1'. The value of '3' thus has to be split between the left and right neighboring positions (4,i−1) and (4,i+1). Deciding which of the left and right neighboring positions receives '2' and which receives '1' can be done randomly, or according to a pre-determined scheme of, for example, alternating priority between columns, or according to which side (left or right) has received more compensation value so far in the column through the iterative computation process. In our example, the right-side neighboring position (4,i+1) is the one that receives the '2' and the left-side neighboring position received the '1'.

Once again, since some of the luminance-debt function LDF has been 'converted' to compensation during this iteration, we again subtract the CF function value, and in this case all of the compensation value in the iteration ('3') has been distributed.

The luminance-debt function LDF, incremented earlier in this iteration to 3, is therefore now decremented by 3, and at the end of the iteration LDF=0. In any case, this is the last iteration since we have arrived at the last row j.

FIG. 15 shows the modifications to the 4×3 matrix of IMG as of the end of the $4^{th}$ and final iteration, and this now represents modified half-toned digital image IMG_MOD.

In some embodiments, the pre-print processor modifies the values of each position (j,i) during each respective iteration step of the iterative computational procedure, at the end of which the image IMG has been modified, and optionally stored in a computer storage medium, as IMG_MOD.

The modified half-toned image, IMG_MOD, is then printed on the target surface.

Figure 16:
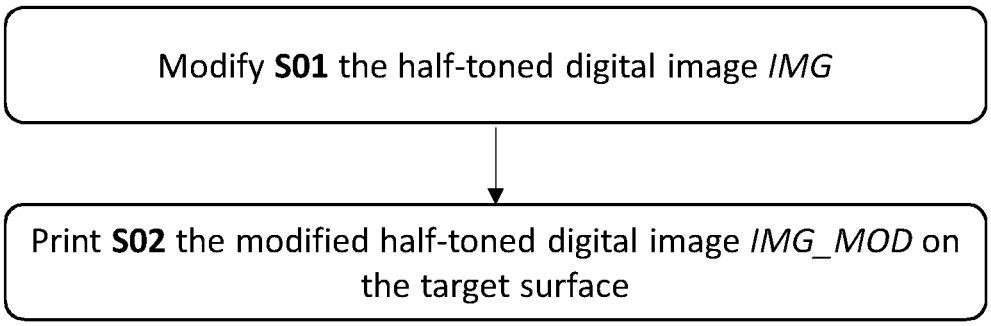
FIGS. 16 and 17 are flowcharts of respective methods for compensating for or reducing the visual effect of a malfunctioning or inoperative nozzle of a printing system, according to embodiments.
Figure 17:
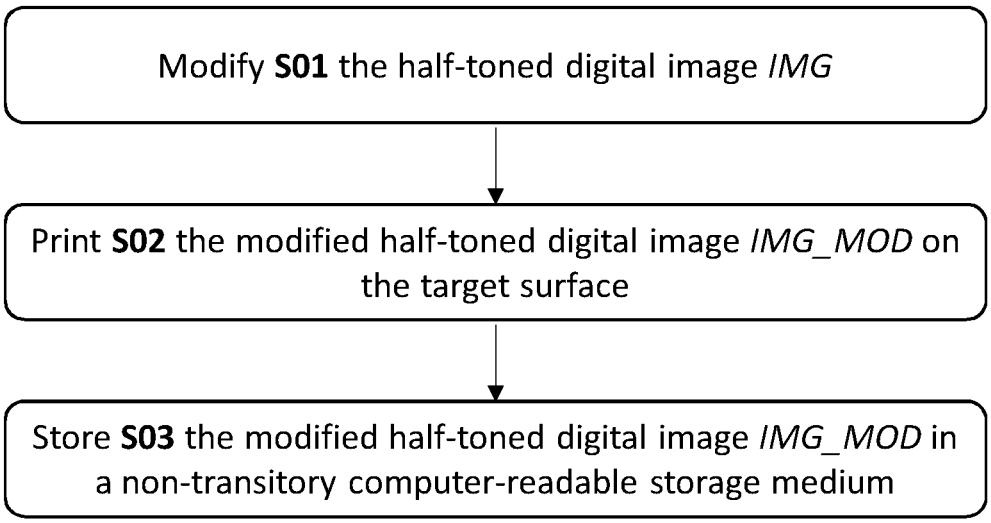

Referring now to FIG. 16, a method is disclosed for compensating for, or reducing the visual effect of, a malfunctioning or inoperative nozzle $Noz_i$ of a printing system such as any of the printing systems disclosed herein. According to the method, the nozzle $Noz_i$ preferably corresponds to the $i^{th}$ column of a half-toned digital image IMG that specifies, for each position (j,i) of the digital image, whether or not an ink droplet is to be deposited at a corresponding location on a target surface along with a respective droplet size DS(j,i). The method comprises:

a) Step S01 modifying the half-toned digital image IMG, using a pre-print digital processor of the printing system to compute a modified version of the half-toned digital image, IMG_MOD. Step S01 is carried out in response to a determination that nozzle $Noz_i$ is malfunctioning or inoperative.

b) Step S02 printing the modified half-toned digital image IMG_MOD on the target surface.

The modifying in Step S01 preferably includes increasing droplet sizes in the half-toned digital image IMG, in first and second neighboring columns, respectively the $(i-1)^{th}$ and $(i+1)^{th}$ columns of the half-toned digital image IMG. In some embodiments, the modifying includes modifying each $j^{th}$ position in one or both of the two neighboring columns if and only if a value of a compensation function is positive. The compensation function CF(j,i) such as disclosed herein with respect to any of the embodiments is suitable for this purpose. In some embodiments, the modifying includes modifying each $j^{th}$ position in one or both of the two neighboring columns if and only if a value of a luminance-debt function exceeds at least a first pre-determined threshold. The luminance-debt function LDF such as disclosed herein with respect to any of the embodiments is suitable for this purpose.

One can make additions to the instructions of one of the compensation functions without changing its logic. For example, a luminance-debt function can be adjusted in each step for any reason so long as it can be seen empirically as improving the outcome of applying the compensation function to actual printed images.

According to some embodiments, the modifying in Step S01 additionally includes setting droplet sizes DS(j,i) for all rows of the $i^{th}$ column to zero.

Figure 18:
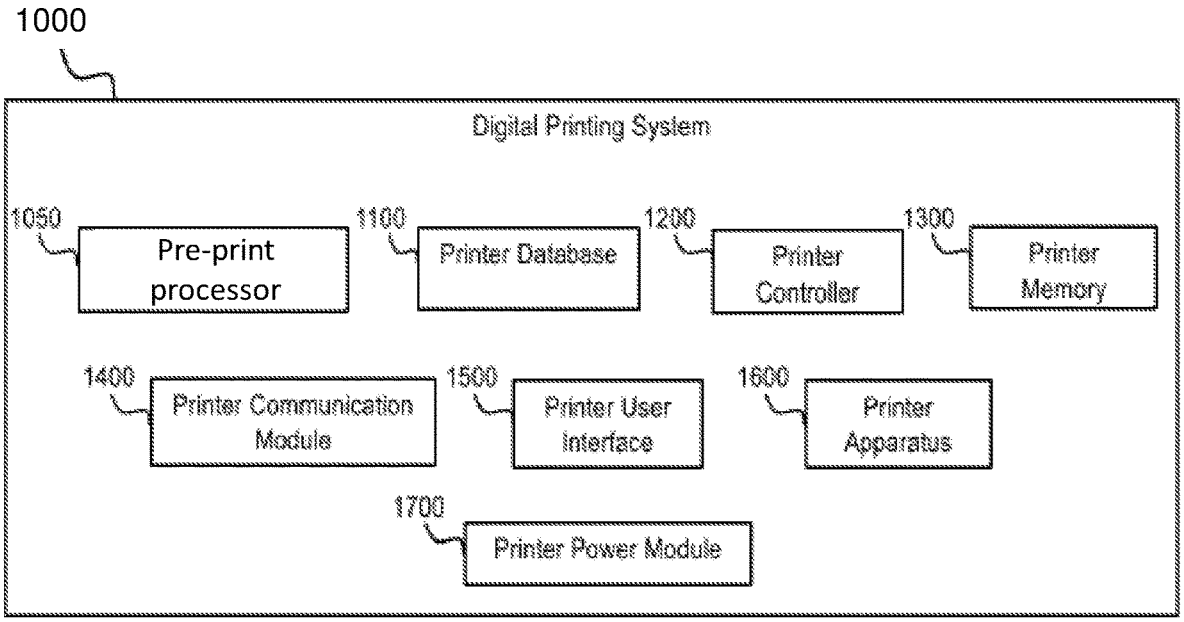
FIG. 18 is a schematic block diagram of a digital printing system, according to embodiments.

In some embodiments, as shown in FIG. 18, the disclosed method comprises the following additional step:

c) Step S03 storing the modified half-toned digital image IMG_MOD in a non-transitory computer-readable storage medium.

Reference is made to FIG. 18. In embodiments, a digital printing system 1000 (for example, the digital printing system 1000 of FIG. 1A) is operative to enable the implementation of a method to execute compensation for a malfunctioning image dot source (e.g., ink nozzle). Such method may herein be implemented by and/or referred to as a "compensation engine" or "pre-print processor", which is schematically illustrated in FIG. 18 as a block referenced by alphanumeric label "1050". Pre-print processor 1050 may be realized by one or more hardware, software and/or hybrid hardware/software modules. The present disclosure may thus, inter alia, be concerned with the implementation of a dot source compensation engine as a pre-print processor 1050 which may allow a digital printing system, such as system 1000, to address and overcome or at least partially remedy the visual problems associated with malfunctioning or inoperative dot sources such as nozzles, as described in the various embodiments.

As shown schematically in FIG. 18, digital printing system 1000 may in some embodiments include a printer database 1100, a printer controller 1200, a printer memory 1300, a printer communication module 1400, a printer user interface 1500, a printer apparatus 1600 and a printer power module 1700 for enabling the powering of the various components of system 1000. As discussed earlier with reference to FIGS. 2A and 3, printer apparatus 1600 in typical embodiments comprises printing heads 2100 and nozzles 2110. The various components of digital printing system 1000 may communicate with each other over one or more communication buses (NOT SHOWN) and/or signal lines (NOT SHOWN).

A database such as printer database 1100 may for example relate to one or more servers, storage systems and/or cloud-based systems and may be employed for storing digital input image data, for example, any of the half-toned digital images discussed herein.

The term "controller" as used herein may additionally or alternatively refer to a processor or central processing unit (CPU). A controller (e.g., printer controller 1200) and/or processor may relate to various types of processors and/or processor architectures including, for example, embedded processors, communication processors, graphics processing unit (GPU)-accelerated computing, soft-core processors and/or embedded processors.

A memory such as printer memory 1300 may include one or more types of computer-readable storage media like, for example, transactional memory and/or long-term storage memory facilities and may function as file storage, document storage, program storage, or as a working memory. The latter may for example be in the form of a static random access memory (SRAM), dynamic random access memory (DRAM), read-only memory (ROM), cache or flash memory. As working memory, printer memory 1300 may, for example, process temporally-based instructions. As long-term memory, printer memory 1300 may for example include a volatile or non-volatile computer storage medium, a hard disk drive, a solid state drive, a magnetic storage medium, a flash memory and/or other storage facility. A hardware memory facility may for example store a fixed information set (e.g., software code) including, but not limited to, a file, program, application, source code, object code, and the like. For the purposes of long-term storage, data fragments may be stored on such long-term memory.

Printer communication module 1400 may allow receiving data from a source which may be external of digital printing system 1000. Printer communication module 1400 may, for example, include I/O device drivers (not shown) and/or network interface drivers (not shown). A device driver may for example, interface with a keypad or to a USB port. A network interface driver may for example execute protocols for the Internet, or an Intranet, Wide Area Network (WAN), Local Area Network (LAN) employing, e.g., Wireless Local Area Network (WLAN), Metropolitan Area Network (MAN), Personal Area Network (PAN), extranet, 2G, 3G, 3.5G, 4G including for example Mobile WIMAX or Long Term Evolution (LTE) advanced, Bluetooth®, ZigBee™ and/or any other current or future communication network, standard, and/or system.

According to some embodiments, printer memory 1300 may include instruction (not shown) which, when executed by printer controller 1200, may cause the execution of methods, processes and/or operations for compensating for a malfunctioning or inoperative nozzle, as outlined herein in greater detail. As already indicated herein, such method, process and/or operation may herein be implemented by and/or referred to as the pre-print processor 1050.

It is noted that the term "dot source compensation" as well as grammatical variations thereof, may encompass any procedures executed by, e.g., pre-print processor 1050, that result in avoiding, or at least in diminishing visually observable deviations from an image which would normally be provided onto the target surface if none of the digital printing system's image dot sources were malfunctioning. It may alternatively be referred to as "nozzle compensation".

In some embodiments, a malfunctioning image dot source may comprise an ink ejection nozzle that does not eject ink as desired and, for example, print in an unevenly, sputtering, weak, spraying, scattering and/or wobbling manner, and/or a nozzle that prints alternatingly in different directions or angles (also dubbed "deviating" nozzle), a nozzle that is fully clogged or partially clogged, and/or any otherwise not correctly functioning nozzle.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons skilled in the art to which the invention pertains.

In the description and claims of the present disclosure, each of the verbs, "comprise", "include" and "have", and conjugates thereof, are used to indicate that the object or objects of the verb are not necessarily a complete listing of members, components, elements or parts of the subject or subjects of the verb. As used herein, the singular form "a", "an" and "the" include plural references unless the context clearly dictates otherwise. For example, the term "a marking" or "at least one marking" may include a plurality of markings.

The invention claimed is:

1. A method of printing an image using a printing system that has a malfunctioning or inoperative nozzle, the malfunctioning or inoperative nozzle corresponding to a column of affected positions in a half-toned digital image, the half-toned digital image specifying the size of each ink droplet to be deposited at a corresponding location on a target surface, the method comprising:

a. responsive to a determination that a nozzle is malfunctioning or inoperative, modifying the half-toned digital image, using a pre-print digital processor of the printing system to compute a modified version of the half-toned digital image, such that droplet sizes are increased only in the two neighboring columns and according to a value of a compensation function; and b. printing the modified half-toned digital image on the target surface, wherein values of the compensation function are defined by an iterative row-by-consecutive-row computation procedure applied to the entirety of the column of affected positions from one end to the other, where for each iteration step:

i. a value of a cumulative luminance-debt function is incremented with data representing the droplet size of an affected position in the respective row of the iteration step, ii. a positive value is assigned to the compensation function if the luminance-debt function exceeds a pre-determined threshold, iii. based on the value of the compensation function, an increase in droplet size is assigned in at least one position in first and second neighboring columns, the at least one position being in the same row and adjacent to the affected position, and iv. the value of the luminance-debt function is decremented with data representing the value of the compensation function.

2. The method of claim 1, wherein modifying the half-toned digital image includes setting droplet sizes for all rows of the column of affected positions to zero.

3. The method of claim 1, wherein the iterative computation procedure applied to the half-toned digital image includes, for each iteration step, increasing the value of the luminance-debt function by a predetermined amount if a value of a counting function is in a pre-determined range, wherein values of the counting function are defined by the iterative computation procedure, where for each iteration step, the value of the counting function is increased if the droplet size in the respective row is non-zero, and reduced if the droplet size is zero.

4. The method of claim 1, additionally comprising the step of storing the modified half-toned digital image in a non-transitory computer-readable storage medium.

5. A method of printing an image using a printing system that has a malfunctioning or inoperative nozzle, the malfunctioning or inoperative nozzle corresponding to a column of affected positions in a half-toned digital image, the half-toned digital image specifying the size of each ink droplet to be deposited at a corresponding location on a target surface, the method comprising:

a. responsive to a determination that a nozzle is malfunctioning or inoperative, modifying the half-toned digital image, using a pre-print digital processor of the printing system to compute a modified version of the half-toned digital image, wherein the computing comprises iterating row-by-consecutive-row over an entirety of the column from one end to the other, each successive iteration step corresponding to a different row of the column, and wherein during each successive step, values of a cumulative luminance-debt function are incremented with row-specific data, a value of a compensation function is set if the luminance-debt function exceeds at least one pre-determined threshold, and based on the value of the compensation function, an increase in droplet size is assigned for at least one position in first and second neighboring columns; and b. printing the modified half-toned digital image on the target surface.

6. A printing system for printing a half-toned digital image that specifies, for each position of the digital image whether or not an ink droplet is to be deposited at a corresponding location on a target surface along with a respective droplet size, the printing system comprising:

a. an array of nozzles for depositing droplets of ink onto the target surface so as to print, each nozzle of the array corresponding to a column of the half-toned digital image; and b. a pre-print processor for controlling deposition of the droplets by the nozzle array according to the content of the half-toned digital image, to print the half-toned digital image or a derivative thereof on the target surface, the pre-print processor comprising a non-transitory computer-readable storage medium containing program instructions for compensating for or reducing the visual effect of a malfunctioning or inoperative nozzle, wherein execution of the program instructions by the pre-print processor causes the pre-print processor to carry out the step of computing a modified version of the half-toned digital image, responsively to a determination that a nozzle is malfunctioning or inoperative, the computing comprising calculation of droplet-size increases in the first and second neighboring columns of a column of affected positions, by iterating row-by-consecutive-row over an entirety of the column from one end to the other, each successive iteration step corresponding to a different row, and by carrying out, for each iteration step, the following steps:

i. incrementing a value of a luminance-debt function with data representing the droplet size of an affected position in the respective row of the iteration step;

ii. determining a value of a compensation function based on the value of the luminance-debt function;

iii. assigning an increase in droplet size in at least one position in first and second neighboring columns, the at least one position being in the same row and adjacent to the affected position, the position being mapped to a functional ink nozzle; and iv. decrementing the value of the luminance-debt function with data representing the value of the compensation function.

7. The printing system of claim 6, wherein computing a modified version of the half-toned digital image includes setting droplet sizes for all rows of the column of affected positions to zero.

8. The printing system of claim 6, wherein the non-transitory computer-readable storage medium contains additional program instructions, the execution of the additional program instructions causing the pre-print processor, when computing a modified version of the half-toned digital image, to carry out, for each iteration step of the calculating droplet-size increases, the following additional steps:

i. increasing a value of a counting function if the droplet size is non-zero;

ii. reducing the value of the counting function if the droplet size is zero; and iii. increasing the value of the luminance-debt function by a predetermined amount if the value of the counting function is in a pre-determined range.

9. The printing system of claim 6, wherein the non-transitory computer-readable storage medium contains additional program instructions, the execution of the additional program instructions causing the pre-print processor to additionally carry out the step of storing the modified half-toned digital image in a non-transitory computer-readable storage medium.

* * * * *